US007877913B1

(12) United States Patent
King

(10) Patent No.: US 7,877,913 B1
(45) Date of Patent: Feb. 1, 2011

(54) MULTI-FACETED, ROTATABLE PROMOTIONAL DISPLAY FOR VEHICLES

(76) Inventor: David L. King, 1 Mountain Laurel La., Lancaster, MA (US) 01523

( * ) Notice: Subject to any disclaimer, the term of this patent is extended or adjusted under 35 U.S.C. 154(b) by 139 days.

(21) Appl. No.: 11/958,250

(22) Filed: Dec. 17, 2007

Related U.S. Application Data

(60) Provisional application No. 60/870,358, filed on Dec. 15, 2006.

(51) Int. Cl.
*G09F 21/04* (2006.01)

(52) U.S. Cl. ..... 40/592; 40/473; 40/493; 40/506; 40/502

(58) Field of Classification Search ..... 40/422, 40/473, 479, 591, 592
See application file for complete search history.

(56) References Cited

U.S. PATENT DOCUMENTS

| | | | | | |
|---|---|---|---|---|---|
| 1,767,570 | A | * | 6/1930 | Ashworth | 40/479 |
| 3,075,311 | A | * | 1/1963 | Maillette | 40/592 |
| 3,660,917 | A | * | 5/1972 | Bevan | 40/473 |
| 4,002,022 | A | | 1/1977 | Lopez | |
| 4,067,128 | A | * | 1/1978 | Kempster | 40/473 |
| 4,073,081 | A | | 2/1978 | Hunter, Jr. | |
| 4,189,859 | A | | 2/1980 | Ahlgren | |
| 4,346,529 | A | | 8/1982 | Keller | |
| 4,381,616 | A | | 5/1983 | Saxer | |
| D271,984 | S | | 12/1983 | Nelson et al. | |
| 4,487,270 | A | * | 12/1984 | Huber | 173/176 |
| D277,299 | S | | 1/1985 | Nelson | |
| 4,528,763 | A | | 7/1985 | Ahlgren | |
| 4,557,517 | A | | 12/1985 | Bolduc et al. | |
| 4,628,624 | A | | 12/1986 | Gunn | |
| 4,667,428 | A | | 5/1987 | Elmer | |
| D290,620 | S | | 6/1987 | Elmer | |
| 4,671,004 | A | | 6/1987 | Berg | |
| 4,787,163 | A | | 11/1988 | Berg | |
| 4,839,975 | A | | 6/1989 | Elmer | |
| 5,083,826 | A | | 1/1992 | McCrary | |
| 5,084,994 | A | | 2/1992 | Elmer | |
| 5,210,970 | A | | 5/1993 | Elmer | |
| 5,233,772 | A | | 8/1993 | Bergeron | |
| D345,125 | S | | 3/1994 | McCrary | |
| 5,309,657 | A | * | 5/1994 | Spencer | 40/473 |
| 5,315,776 | A | | 5/1994 | Strawbridge et al. | |
| 5,330,039 | A | * | 7/1994 | Baker | 192/30 W |
| 5,343,645 | A | | 9/1994 | Huber | |
| 5,379,540 | A | | 1/1995 | Howard | |

(Continued)

*Primary Examiner*—Lesley Morris
*Assistant Examiner*—Christopher E Veraa
(74) *Attorney, Agent, or Firm*—O'Connell Law Firm

(57) ABSTRACT

A multi-faceted, rotatable promotional display device for being retained relative to a vehicle for enabling the perception of multiple promotional messages from a single vantage point. A display casing with multiple display surfaces is rotatably retained relative to a base structure. Promotional messages are displayed relative to the display surfaces, and a drive arrangement rotates the display casing relative. The display casing can have a square, triangular, or other cross section. The base structure can have a cup portion with a raised peripheral ridge, and a shell can envelope the display casing. The display surfaces can be electronic display screens or light transmissive panels. A light source can be disposed within the display casing. A drive motor can be powered by a battery, a photovoltaic array, or a wind turbine. A clutch or a force sensor can prevent the application of excessive rotational force.

17 Claims, 5 Drawing Sheets

U.S. PATENT DOCUMENTS

| | | | | |
|---|---|---|---|---|
| 5,412,892 | A | 5/1995 | Filippakis | |
| 5,416,996 | A | 5/1995 | Clemens | |
| 5,494,445 | A | 2/1996 | Sekiguchi et al. | |
| 5,507,109 | A | 4/1996 | Rinzler | |
| 5,649,730 | A | 7/1997 | Ramos | |
| 5,692,331 | A | 12/1997 | Tipke | |
| 5,711,100 | A | 1/1998 | Elmer | |
| 5,918,924 | A | 7/1999 | Cowan | |
| 5,966,856 | A | 10/1999 | Alu | |
| 6,056,425 | A | 5/2000 | Appelberg | |
| 6,065,232 | A | 5/2000 | Haughey et al. | |
| 6,076,293 | A | 6/2000 | Bergeron | |
| 6,122,850 | A | 9/2000 | Strzeletz | |
| 6,128,841 | A | 10/2000 | Werner | |
| 6,145,230 | A | 11/2000 | Holmberg | |
| 6,256,912 | B1 | 7/2001 | Gibson et al. | |
| D466,449 | S | 12/2002 | Buring et al. | |
| D466,837 | S | 12/2002 | Buring et al. | |
| 6,522,263 | B2 * | 2/2003 | Jones | 340/915 |
| 6,568,110 | B2 | 5/2003 | Lee et al. | |
| 6,598,327 | B1 | 7/2003 | Strzeletz | |
| 6,702,351 | B2 | 3/2004 | Buring et al. | |
| 6,769,726 | B1 | 8/2004 | Clark | |
| 7,121,026 | B2 | 10/2006 | Chen | |
| 7,121,700 | B1 | 10/2006 | Scanlon | |
| 2002/0062589 | A1 | 5/2002 | Miller | |
| 2002/0152657 | A1 | 10/2002 | Lee et al. | |
| 2003/0178867 | A1 | 9/2003 | Buring et al. | |
| 2004/0172870 | A1 | 9/2004 | Buring et al. | |
| 2004/0226204 | A1 | 11/2004 | Green | |
| 2005/0001433 | A1 * | 1/2005 | Seelin | 290/44 |
| 2006/0242872 | A1 | 11/2006 | Lonsk | |
| 2008/0028650 | A1 * | 2/2008 | Ratcliffe | 40/591 |

* cited by examiner

MULTI-FACETED, ROTATABLE PROMOTIONAL DISPLAY FOR VEHICLES

FIELD OF THE INVENTION

This invention relates generally to advertising displays. More particularly, disclosed and protected herein is a multi-faceted, rotatable promotional display for being retained relative to a motor vehicle to draw consumer attention to multiple, changing display surfaces with plural commercial messages.

BACKGROUND OF THE INVENTION

For many years, the sides and roofs of vehicles have been employed to retain display arrangements for advertising and identification purposes. Panel signs are commonly fixed to the sides of cars, trucks, and buses to provide a single viewing surface, such as for identifying and advertising the business conducted by the owner or for advertising other products and services. Further display arrangements take the form of dual-sided signs that are retained relative to the roof of a vehicle, such as a taxicab or a private vehicle. Advantageously, such rooftop signs provide first and second viewing surfaces whereby advertising or identifying information can be perceived from both sides of the vehicle and whereby first and second different advertising messages can potentially be displayed. The prior art has also disclosed triangular signs for being retained atop a vehicle whereby three display surfaces are viewable over a wide range of viewing angles.

Ultimately, added display surfaces yield added display space. Greater display space translates into greater attention for the advertising message and, consequently, greater advertising benefits and advertising revenue. Still further, the ability to display multiple messages on a single display device enables the display of multiple complementary messages or multiple distinct messages. Therefore, advertisers and advertising providers have continually sought to provide increased display area, to draw increased attention to the displayed message, and, where desirable, to enable the display of multiple messages in relation to a single advertising display.

While advantageous for their added number of display surfaces and the resultantly increased surface area of display, even the multi-sided display devices of the prior art suffer from a number of drawbacks. For example, each observer may see only one of the multiple display surfaces and, therefore, only one of the displayed messages. The remaining display surfaces are often incapable of being viewed from a single vantage point. With this, the advertising messages on the unseen display surfaces are ineffective relative to the stationary observer. Certain messages are effectively lost, and messages on the multiple surfaces cannot effectively be used to relay complementary advertising messages. Furthermore, with their presence having become utterly common in everyday life, consumers have come to pay little attention to the stagnant display devices of the prior art. Due to the mundane nature of the advertising displays, consumers allow vehicles retaining the same to pass without giving so much as a glance to the advertising messages retained thereon.

Thus, it would be desirable to provide a promotional display device for being retained relative to a vehicle that overcomes these and further problems and deficiencies encountered with previously devised vehicle mounted signage. It would be advantageous to provide such a display device that provides multiple display surfaces to enable the display of plural advertising messages, whether those messages be independent or related. It would be particularly desirable to provide a promotional display device that enables an observer to view each of the plurality of advertising messages from a single viewpoint. Even further, it would be desirable to provide a promotional display device that compels the attention of observers through its unique configuration and operation thereby to ensure that retained messages receive the attention that the advertiser so richly desires.

SUMMARY OF THE INVENTION

With an appreciation for the state of the art summarized above, the present inventor set forth with the basic object of creating a promotional display device for vehicles that remedies the shortcomings of prior art display devices while providing a plurality of further advantages even beyond those achieved by previously disclosed structures.

A more particular object of embodiments of the invention is to provide a promotional display device that is capable of exhibiting multiple display surfaces thereby to enable the display of multiple independent or related advertising messages.

A related object of the invention is to provide a dynamic promotional display device that enables an observer to perceive each of a plurality of advertising messages from a single viewpoint whereby multiple distinct messages can be viewed and whereby, in alternative manifestations, multiple related messages can be employed in cooperation.

Yet another object of the invention is to provide a promotional display device that is unique in structure and performance to draw the attention of observers so that retained advertising messages enjoy close attention and maximized commercial effects.

These and in all likelihood further objects and advantages of the present invention will become obvious not only to one who reviews the present specification and drawings but also to those who have an opportunity to observe an embodiment of the promotional display device disclosed herein in operation. However, it will be appreciated that, while the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth these objects, a basic embodiment of the multi-faceted, rotatable promotional display device can be founded on a display casing that is rotatably retained relative to a base structure. The display casing has multiple display surfaces, such as by being square, triangular, or otherwise presenting multiple surfaces. Each display surface can retain and display a promotional message, and the multiple promotional messages can be independent or related. A drive arrangement can be operable to rotate the display casing continuously or intermittently. Under even this basic arrangement, the display casing can be rotated relative to the base structure and the vehicle to enable each of the promotional messages to be perceived from a single vantage point.

The display device can include a means, such as straps, fasteners, adhesive, or the like, for securing the base structure relative to the vehicle. Substantially any type of vehicle can be employed including, for example, an automobile or a truck.

In certain embodiments, the base structure can include a cup portion with a raised peripheral ridge. A base portion of the display casing can be disposed within the cup portion. With this, the risk of inadvertent contact and tangling with the rotating display casing can be minimized. The display device can be employed devoid of a shell enveloping the display casing so that the display casing can be rotated relative to the base structure and the vehicle without a shell being interposed between a viewer and the display casing. In further embodiments, however, a shell can be retained relative to the base structure to envelope the display casing thereby providing mutual protection to the display casing, bystanders, and surrounding objects.

The display surfaces can in some embodiments take the form of light transmissive panels. In such constructions, a light source can be disposed within the display casing to backlight the display surfaces and the retained promotional messages. In other embodiments, each display surface can comprise an electronic display screen, such as an LED, LCD, plasma or other display arrangement.

The drive arrangement for rotating the display casing relative to the base structure can take many forms under the invention. For example, a motor and a power source, such as a battery, can rotate the display casing. In some embodiments, the power source can comprise a photovoltaic array whereby energy from the sun can be harvested to power the display device, possibly by being retained and stored in a battery. Other embodiments of the invention can harvest wind energy through a wind turbine, which can directly drive the display casing or which can provide electrical power through a generator. The application of excessive rotational force by the drive arrangement can be prevented, such as by a clutch and, additionally or alternatively, by a force sensor and a means for limiting or disengaging the drive arrangement in response to a sensing of excessive rotational forces.

One will appreciate that the foregoing discussion broadly outlines the more important features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

As is the case with many inventions, the present invention for a multi-faceted, rotatable promotional display device for being retained relative to a motor vehicle is subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Before any particular embodiment of the invention is explained in detail, it must be made clear that the following details of construction and illustrations of inventive concepts are mere examples of the many possible manifestations of the invention.

Figure 1:
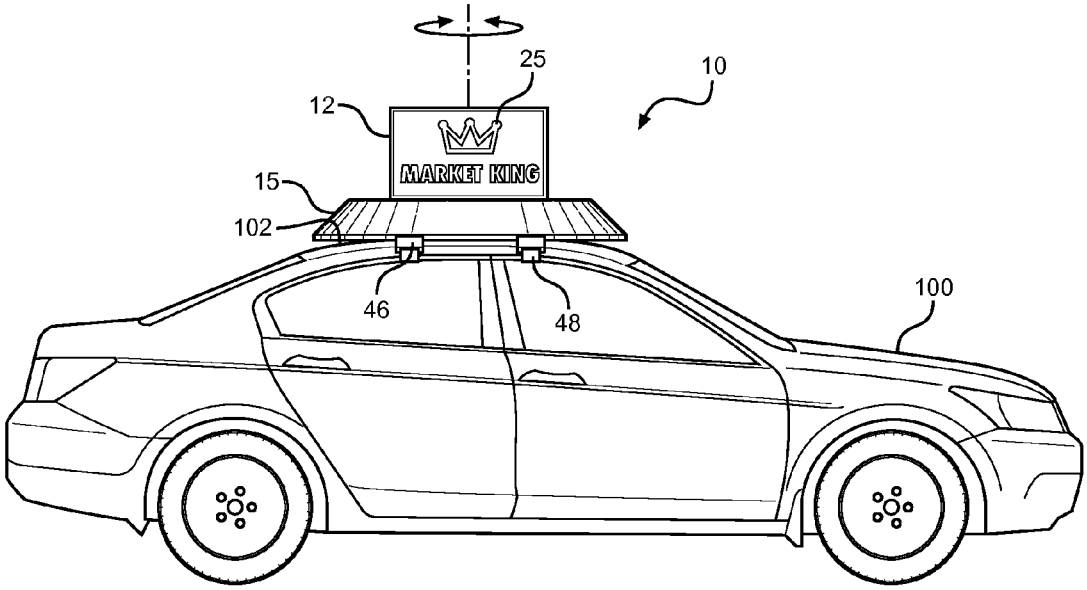
FIG. 1 is a view in side elevation of a multi-faceted, rotatable promotional display according to the present invention retained relative to a motor vehicle.
Figure 3:
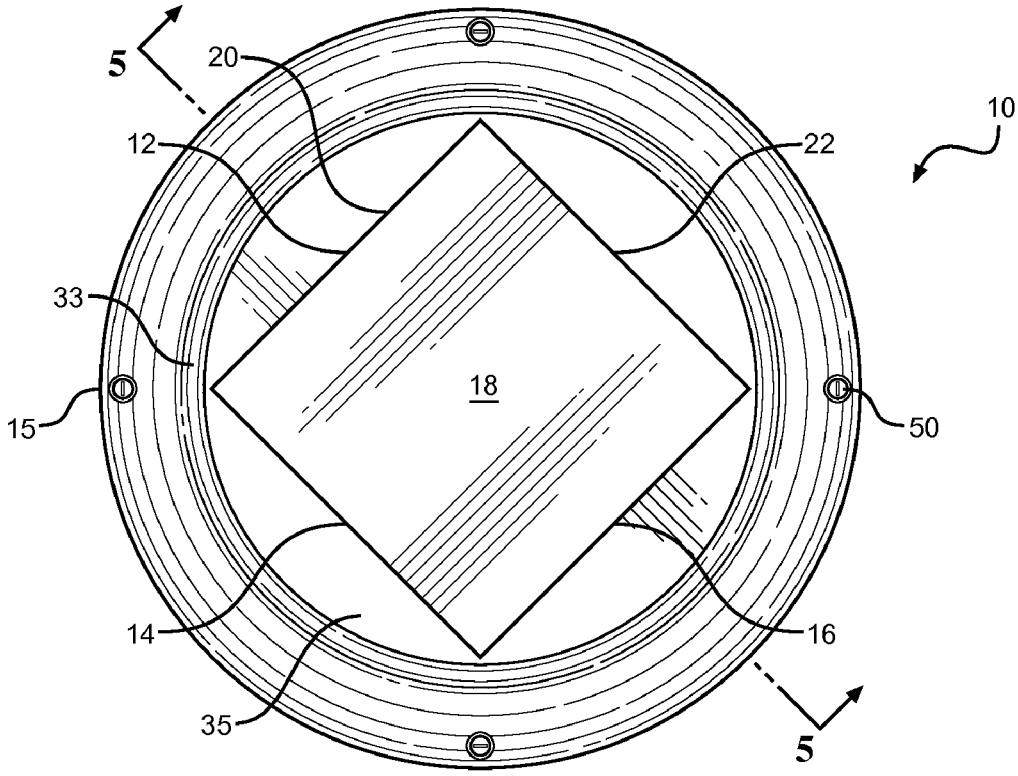
FIG. 3 is a top plan view of the multi-faceted, rotatable promotional display of FIG. 2.
Figure 4:
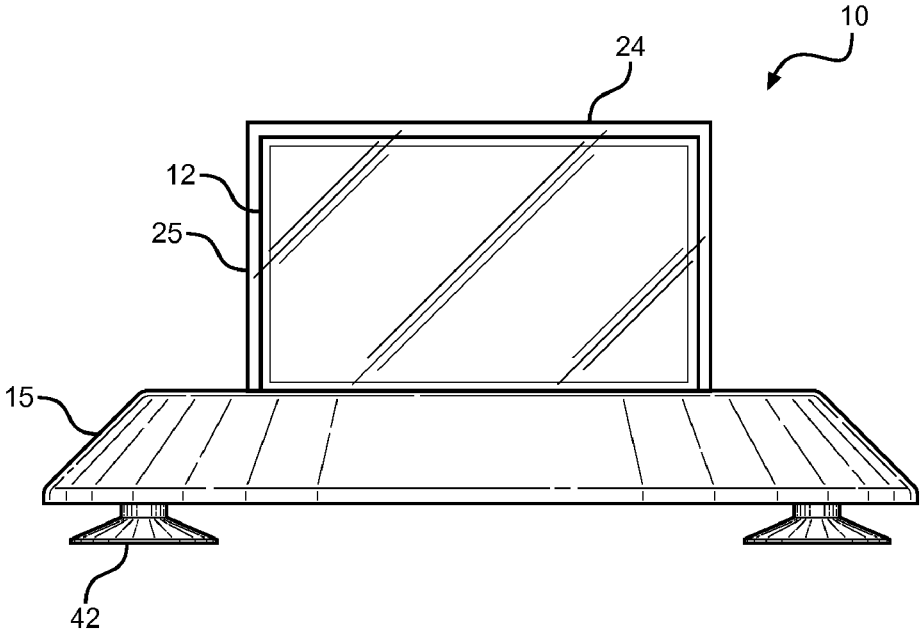
FIG. 4 is a view in side elevation of an alternative multi-faceted, rotatable promotional display.

Turning more particularly to the drawings, an embodiment of a multi-faceted, rotatable promotional display device according to the present invention is indicated generally at 10 in FIG. 1. There, the promotional display device 10 is retained relative to a motor vehicle 100, which in this example comprises an automobile. Straps 46 and clamping members 48 secure the promotional display device 10 atop the roof 102 of the motor vehicle 100. It will be appreciated that the promotional display device 10 can be retained relative to the vehicle 100 in any suitable location and by any other effective means, including, by way of example, one or more threaded bolt fasteners 50 as shown in FIG. 3, suction cups 42 as shown in FIG. 4, adhesive, or any other arrangement. While the vehicle 100 depicted in FIG. 1 comprises an automobile, it will be clear that the vehicle 100 could comprise any other type of vehicle, including a truck as in FIG. 9, a bus, a motorcycle, a bicycle, watercraft, a helicopter, a trailer, a parade float, a train, a construction vehicle, or substantially any other vehicle.

Figure 2:
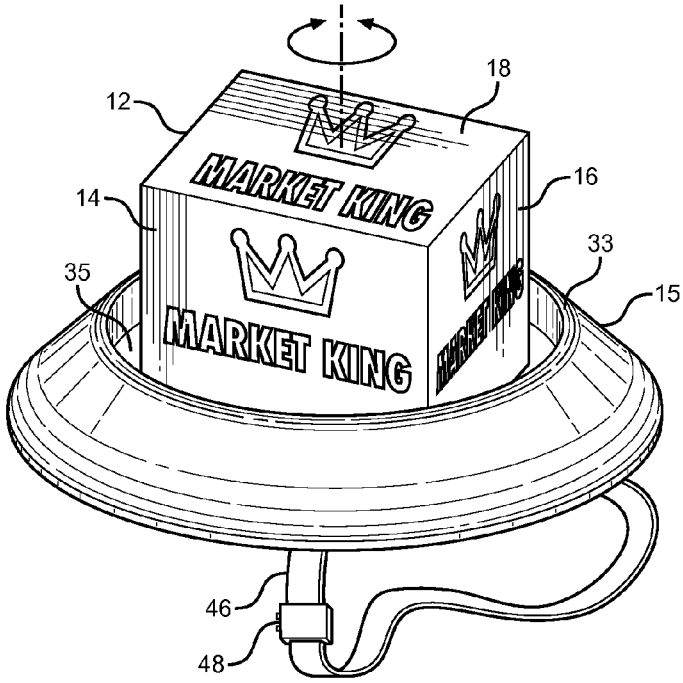
FIG. 2 is a perspective view of a multi-faceted, rotatable promotional display as disclosed herein.

With additional reference to FIGS. 2 and 3, the promotional display device 10 can be seen to have a display casing 12 that is retained for rotation relative to a base structure 15. In the depicted embodiment, the rotatable display casing 12 is cube shaped with five potential display surfaces, namely first, second, third, and fourth sidewall display surfaces 14, 16, 20, and 22 and a top display surface 18. As FIG. 1 shows, each display surface 14, 16, 18, 20, and 22 can retain a promotional message 25 thereon. The promotional messages 25 can be independent of one another, such as by comprising advertisements from different advertisers or relating to different products or services. Alternatively, the promotional messages 25 can be related or complementary, such as by being identical or by relaying a unified advertising message.

As depicted in the embodiment of FIGS. 2 and 3, the base structure 15 can have a cup portion 35 defined by a raised peripheral rim 33. The peripheral rim 33 can have an inner diameter marginally greater than the largest cross-sectional dimension of the display casing 12. With this, the display casing 12 can rotate within the cup portion 35 without risk of undesirable contact with bystanders or surrounding objects. Unlike the display device 10 shown, for example, in FIG. 4 where a shell 24 is included, the display device 10 as depicted in FIGS. 2 and 3 can be seen to be devoid of a shell 24 enveloping the display casing 12 whereby the display casing 12 can be rotated relative to the base structure 15 and the vehicle 100 without a shell 24 being interposed between a viewer and the display casing 12.

If necessary or desirable to protect the display casing 12 and to provide further protection against inadvertent contact with the moving display casing 12, the display casing 12 can in certain cases be enveloped by a transparent shell 24 as shown in FIG. 4. The shell 24 can be round in cross section and can be fastened to the base structure 15 by any effective method including, for example, adhesive, snap fit engagement, mechanical fasteners, or any other means. The shell 24 can be crafted from any suitable material including clear plastic or glass.

The display surfaces 14, 16, 18, 20, and 22 of the display casing 12 can comprise flat or non-flat panels. The display surfaces 14, 16, 18, 20, and 22 can be translucent or transparent, and promotional messages 25 can be applied thereto in any appropriate way including by printing, by the removable retention of a printed panel, or by any other effective method. Where the display surfaces 14, 16, 18, 20, and 22 are transparent or translucent, the promotional messages 25 can be backlit and illuminated by one or more light sources 26 retained within the display casing 12.

In an alternative embodiment, the display surfaces 14, 16, 18, 20, and 22 can comprise display screens, each providing its own light. For example, the display surfaces 14, 16, 18, 20, and 22 could be LCD, plasma, LED, or other electronic display screens. Under such constructions, promotional messages 25 can be changed electronically and plural or video images can be displayed.

Figure 5:
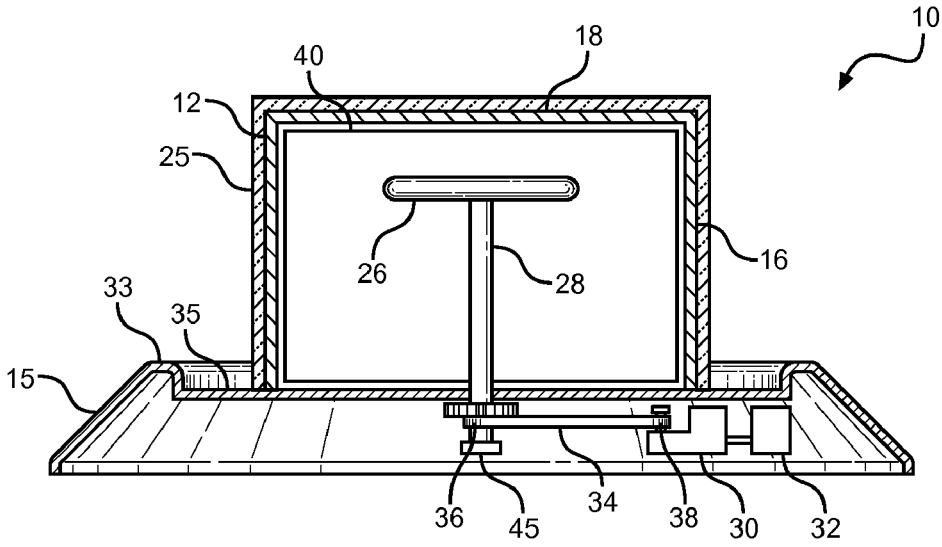
FIG. 5 is a view in cross section of the multi-faceted, rotatable promotional display taken along the line 5-5 in FIG. 3.

As the cross-sectional view of FIG. 5 illustrates, display surfaces 14, 16, 18, 20, and 22 can be joined by an internal framework 40. The framework 40 could be of any suitable construction. For example, the framework 40 can be formed from metal, plastic, wood, or any combination thereof. Alternatively, the display surfaces 14, 16, 18, 20, and 22 could be coupled by adhesive, by fasteners, heat-sealing, or by being integrally formed, such as by molding.

During operation of the promotional display device 10, the display casing 12 can be rotated continuously or intermittently by any suitable mechanism. In the embodiment of FIG. 5, the display casing 12 is rotated by a motor 30 that receives power from a power source 32. The motor 30 can be drivingly associated with an axle 28 of the display casing 12 by a drive arrangement, which in the present example comprises a drive belt or chain 34 in combination with drive pulleys 36 and 38. The drive pulleys 36 and 38, gearing, or any other means can accomplish any necessary speed reduction between the motor 30 and the axle 28. In alternative embodiments, the motor 30 can rotate the axle by a hydraulic drive arrangement (not shown).

The drive system can incorporate a means for preventing continued spinning of the display casing 12 in the event of an obstruction, such as might result from inadvertent contact with a bystander or surrounding object, or other malfunction. For example, a sensing arrangement 45 can be operably associated with the drive arrangement. The sensing arrangement 54 can disengage the drive arrangement in response to a perceived excess in force required to rotate the display casing 12. Alternatively or additionally, the sensing arrangement 45 can comprise a simple clutch to prevent the application of excessive rotational force to the axle 28 and, consequently, the display casing 12.

A light source 26, in this case an annular bulb, is disposed within the display casing 12, such as by being retained relative to the axle 28, for illuminating the promotional messages 25 disposed on the display surfaces 14, 16, 18, 20, and 22 where the display surfaces 14, 16, 18, 20, and 22 are translucent or transparent. Of course, additional light sources 26 are possible where necessary for proper illumination of the display casing 12.

In the embodiment of FIG. 5, the motor 30 and power source 32 are depicted as being within the base structure 15. However, it will be appreciated that either or both could be disposed in the display casing 12 or elsewhere. Furthermore, power for the motor 30 and the light source 26 could alternatively come from external to the display device 10, such as from the electrical system of the vehicle 100.

Figure 8:
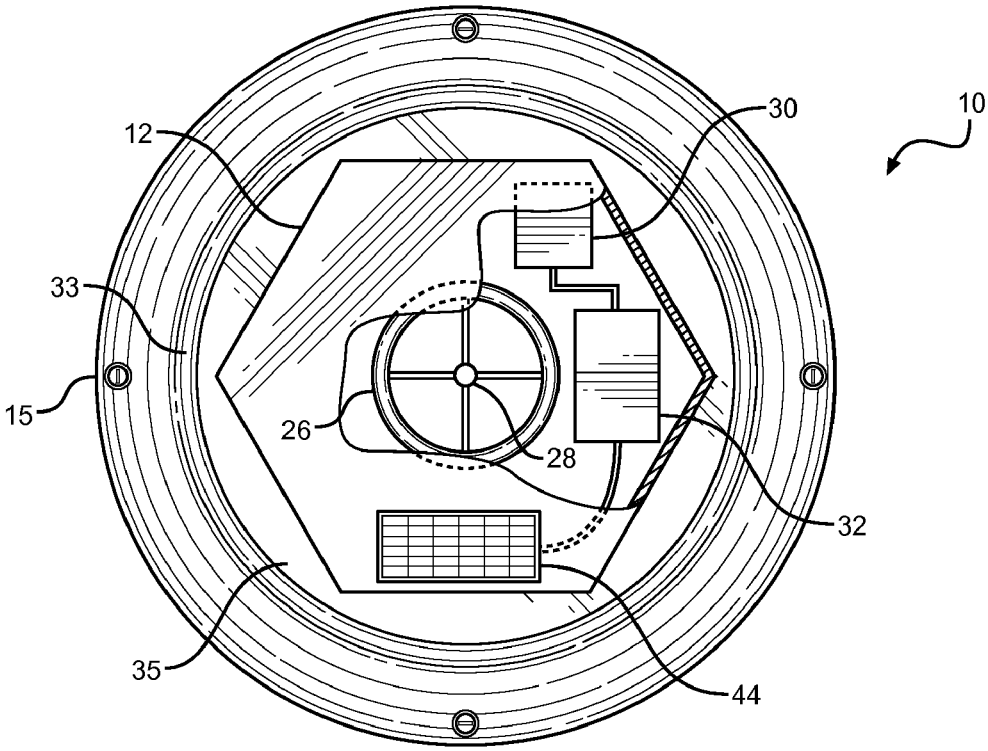
FIG. 8 is a partially sectioned top plan view of a further multi-faceted, rotatable promotional display as taught herein.

In another potential refinement of the invention as depicted in FIG. 8, power for the motor 30 and the light source 26 could come entirely or partially from solar power. A photovoltaic array 44 can be retained relative to the display device 10, such as by being disposed atop the display casing 12. The photovoltaic array 44 can transmit electric power harvested from the sun's rays for retention by the power source 32, which can comprise a battery for receiving and storing electric power. The power source 32 can than provide acquired electrical energy to the motor 30 and the light source 26. In alternative embodiments, the power source 32 could be eliminated, and power acquired by the photovoltaic array 44 can be transmitted directly to the motor 30 and, possibly, the light source 26. In any case, the exploitation of solar energy can enable the display device 10 to operate essentially autonomously.

Figure 9:
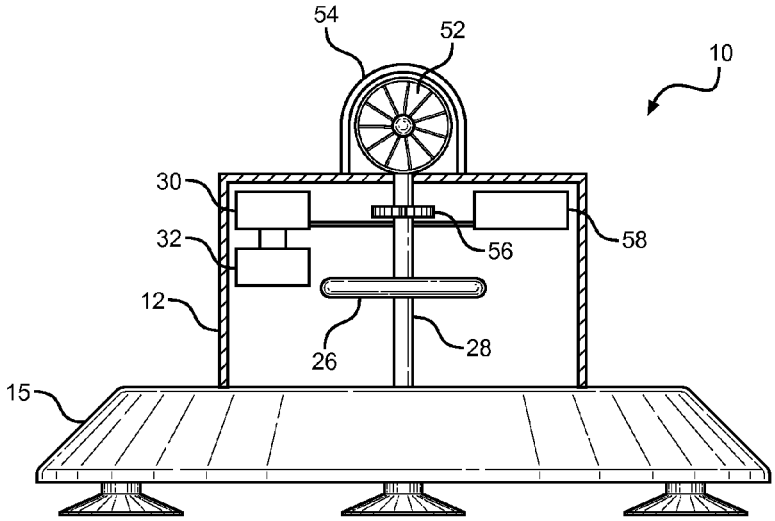
FIG. 9 is a view in front elevation of yet another embodiment of a multi-faceted, rotatable promotional display.

Further embodiments can exploit other alternative energy sources. For example, as shown in FIG. 9, power for rotating the display device 12 and illuminating the light source 26 can come entirely or partially from a wind turbine 52 operably associated with the display device 10, such as by being disposed atop the display casing 12. The wind turbine 52, which can be housed in a cowling 54, can mechanically rotate the axle 28 and the display casing 12 through drive gearing 56. Alternatively or additionally, mechanical power from the wind turbine 52 can be converted to electrical power by a generator 58, which can provide power to the motor 30 and the light source 26 and, potentially, to the battery power source 32 for storage and subsequent usage.

Figure 6:
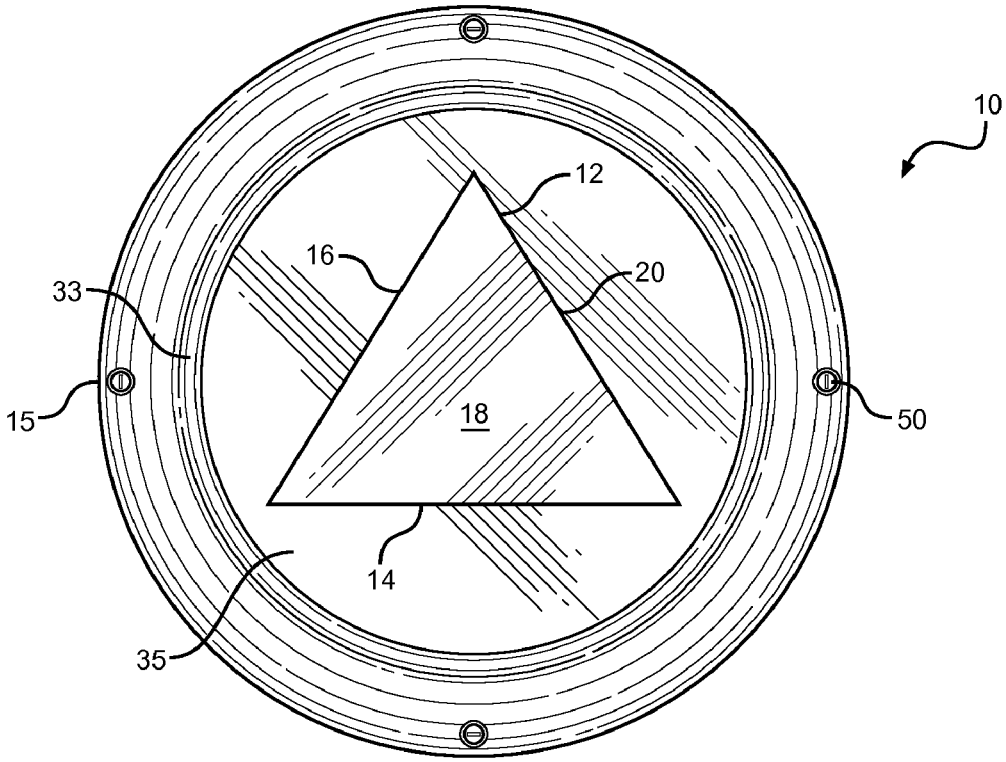
FIG. 6 is a top plan view of another multi-faceted, rotatable promotional display pursuant to the present invention.
Figure 7:
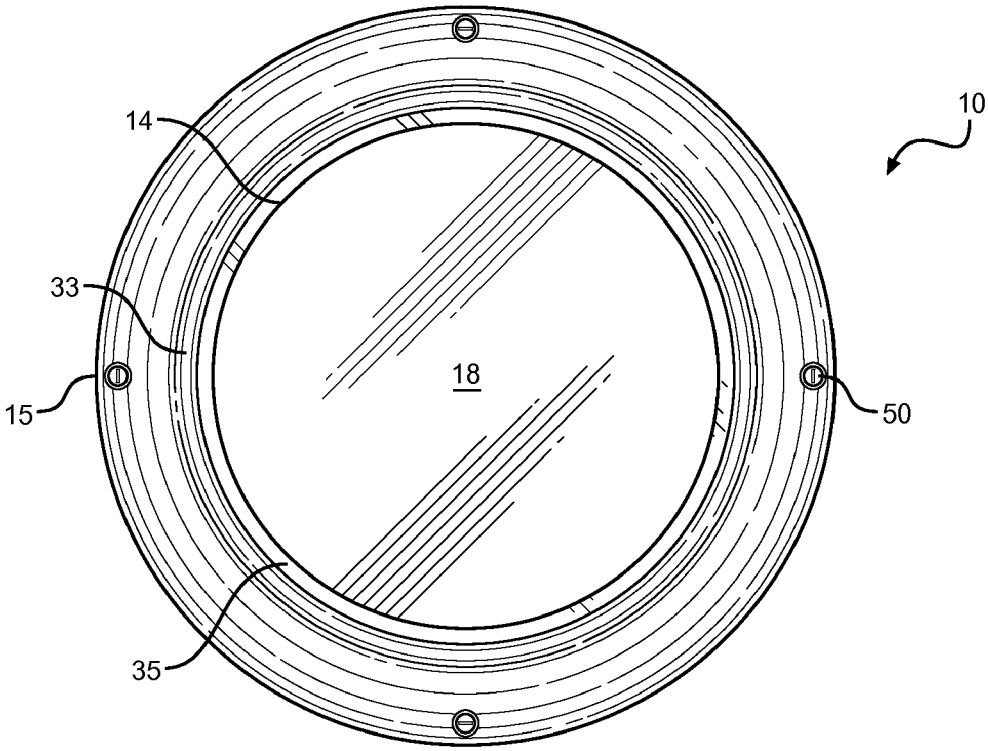
FIG. 7 is a top plan view of still another multi-faceted, rotatable promotional display pursuant to the present invention.

As discussed above, the embodiment of the display casing 12 of FIGS. 1 through 5 is cube shaped whereby it presents four side display surfaces 14, 16, 20, and 22 and a top display surface 18. However, it is contemplated that the display casing 12 can pursue different shapes and can have different numbers of display surfaces. For example, as in the embodiment of FIG. 6, the display casing 12 is triangular in cross section whereby first, second, and third side display surfaces 14, 16, and 20 and a top display surface 18 are provided. In the further embodiment of FIG. 7, the display casing 12 can be round in cross section thereby to provide a continuous round display surface 14 and a top display surface 18. Even further, as in FIG. 8, the display casing 12 has a hexagon cross section thereby to provide six side display surfaces and a top display surface 18. These and further shapes for the display casing 12 are possible and within the scope of the invention.

Figure 10:
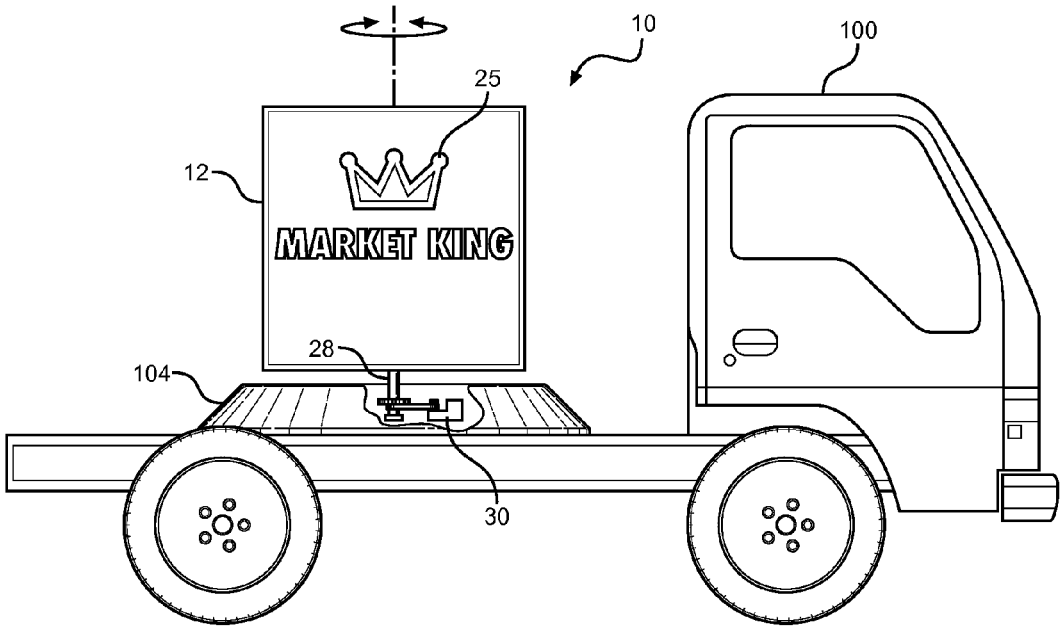
FIG. 10 is a view in side elevation of an alternative multi-faceted, rotatable promotional display retained relative to a motor vehicle.

It was previously noted that display devices 10 according to the present invention can be retained relative to numerous different types of vehicles 100. For example, as FIG. 10 shows, display devices 10 as taught herein can alternatively be retained relative to a vehicle 100 comprising a truck 100 with a bed portion 104. The display casing 12 can be rotatably retained relative to the bed portion 104 of the truck 100 by an axle 28 that is driven by a motor 30. The display casing 12 can have backlit display surfaces or individually powered electronic displays. The motor 30 and one or more light sources (not shown in FIG. 10) or the display surfaces themselves can receive power from any suitable power source, including a dedicated battery, the electrical system of the vehicle 100, or an alternative energy source as described above.

Based on the foregoing, it will be appreciated that multifaceted, rotatable promotional display devices 10 according to the present invention achieve a number of advantages over prior art display devices. For example, by providing multiple display surfaces 14, 16, 18, 20, and 22, the display device 10 can exhibit multiple advertising messages, which can be independent or related. With the rotation of the display casing 12, whether continuously or intermittently, the display device 10 enables an observer to perceive each of the plurality of advertising messages 25 from a single viewpoint. With this, multiple distinct messages can be viewed and, in alternative manifestations, multiple related messages 25 can be employed in cooperation. Even further, with its unique construction and operation, the promotional display device 10 tends to compel the attention of observers whereby retained advertising messages 25 are closely watched and whereby their commercial effect is maximized.

With certain details of the present invention for a multi-faceted, rotatable promotional display device disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims express certain elements as means for performing a specific function, at times without the recital of structure or material. As the law demands, these claims shall be construed to cover not only the corresponding structure and material expressly described in this specification but also all equivalents thereof that might be now known or hereafter discovered.

I claim as deserving the protection of Letters Patent:

1. A multi-faceted, rotatable promotional display device for being retained relative to a vehicle for enabling the display of multiple promotional messages, display device comprising:

a base structure;

a display casing rotatably retained relative to the base structure wherein the display casing has multiple display surfaces;

means for displaying a promotional message relative to each of the plurality of display surfaces;

a drive arrangement for rotating the display casing relative to the base structure;

wherein the base structure includes a cup portion with a raised peripheral ridge and wherein a base portion of the display casing is disposed within the cup portion;

wherein the display casing has a height and a greatest lateral dimension, wherein the peripheral ridge has an inner diameter greater than the lateral dimension of the display casing, and wherein the peripheral ridge is raised only a portion of the height of the display casing;

wherein the display device is devoid of a shell enveloping the display casing whereby the display casing can be rotated relative to the base structure and the vehicle to enable each of the promotional messages to be perceived from a single vantage point without a shell being interposed between a viewer and the display casing.

2. The display device of claim 1 further comprising a means for securing the display device relative to the vehicle.

3. The display device of claim 1 wherein the display casing has a multi-sided cross-sectional shape.

4. The display device of claim 3 wherein the display casing is cube shaped with first, second, third, and fourth sidewall display surfaces.

5. The display device of claim 1 wherein each display surface comprises a light transmissive panel and further comprising a light source disposed within the display casing.

6. The display device of claim 1 wherein the drive arrangement for rotating the display casing relative to the base structure comprises a motor and a power source.

7. The display device of claim 6 wherein the power source comprises a photovoltaic array retained atop the display casing.

8. The display device of claim 7 wherein the power source further comprises a battery for receiving and retaining power harvested by the photovoltaic array.

9. The display device of claim 1 wherein the drive arrangement for rotating the display casing relative to the base structure comprises a wind turbine.

10. The display device of claim 9 wherein the drive arrangement further comprises drive gearing powered by the wind turbine for applying rotational force to the display casing.

11. The display device of claim 9 wherein the drive arrangement further comprises a generator for converting energy harvested by the wind turbine to electrical power.

12. The display device of claim 11 wherein the drive arrangement further comprises a battery for receiving and retaining power harvested by the wind turbine.

13. The display device of claim 1 further comprising a means for preventing the application of excessive rotational force by the drive arrangement for rotating the display casing.

14. The display device of claim 13 wherein the means for preventing the application of excessive rotational force comprises a clutch.

15. The display device of claim 13 wherein the means for preventing the application of excessive rotational force comprises a force sensor and a means for disengaging the drive arrangement in response to a sensing of excessive rotational forces.

16. The display device of claim 1 further comprising a vehicle for transporting the display device.

17. The display device of claim 16 wherein the vehicle is chosen from the group consisting of an automobile and a truck.

* * * * *